US006612367B2

(12) United States Patent
Abdulnour et al.

(10) Patent No.: US 6,612,367 B2
(45) Date of Patent: Sep. 2, 2003

(54) HEAT EXCHANGER AND METHOD OF MAKING SAME

(75) Inventors: Ramez S. Abdulnour, West Bloomfield, MI (US); Kevin Bennett Wise, Connersville, IN (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/978,196

(22) Filed: Oct. 15, 2001

(65) Prior Publication Data

US 2002/0121363 A1 Sep. 5, 2002

Related U.S. Application Data

(62) Division of application No. 09/470,383, filed on Dec. 22, 1999, now Pat. No. 6,338,383.

(51) Int. Cl.[7] ..... F28D 1/03

(52) U.S. Cl. ..... 165/153; 165/174; 29/890.07

(58) Field of Search ..... 165/153, 174, 165/126, 167; 52/515; 29/890.052, 890.07

(56) References Cited

U.S. PATENT DOCUMENTS

| | | | | |
|---|---|---|---|---|
| 3,563,303 A | | 2/1971 | Gilli et al. | |
| 3,976,128 A | | 8/1976 | Patel et al. | |
| 4,081,025 A | | 3/1978 | Donaldson | |
| 4,202,182 A | | 5/1980 | Kawashima et al. | |
| 4,274,482 A | | 6/1981 | Sonoda | |
| 4,370,868 A | | 2/1983 | Kim et al. | |
| 4,434,643 A | | 3/1984 | Almqvist et al. | |
| 4,487,038 A | * | 12/1984 | Iijima | 62/515 |
| 4,524,823 A | * | 6/1985 | Hummel et al. | 165/174 |
| 4,600,053 A | | 7/1986 | Patel et al. | |
| 4,955,222 A | | 9/1990 | Reccius | |
| 5,062,477 A | | 11/1991 | Kadle | |
| 5,101,891 A | | 4/1992 | Kadle | |
| 5,111,878 A | | 5/1992 | Kadle | |
| 5,211,222 A | | 5/1993 | Shinmura | |
| 5,237,849 A | | 8/1993 | Miyazawa | |
| 5,390,507 A | | 2/1995 | Shimoya et al. | |
| 5,409,056 A | | 4/1995 | Farry, Jr. et al. | |
| 5,447,194 A | | 9/1995 | Hayashi et al. | |
| 5,630,473 A | | 5/1997 | Nishishita | |
| 5,651,268 A | * | 7/1997 | Aikawa et al. | 138/44 |
| 5,794,691 A | | 8/1998 | Evans et al. | |
| 5,806,586 A | | 9/1998 | Osthues et al. | |
| 5,819,579 A | | 10/1998 | Roberts | |
| 5,881,805 A | | 3/1999 | Inoue et al. | |
| 5,934,367 A | * | 8/1999 | Shimmura et al. | 165/153 |
| 6,059,026 A | * | 5/2000 | Bailly et al. | 165/158 |
| 6,220,342 B1 | | 4/2001 | Nishishita et al. | |
| 6,338,383 B1 | * | 1/2002 | Abdulnour et al. | 165/153 |

FOREIGN PATENT DOCUMENTS

| | | |
|---|---|---|
| JP | 56-1229 | 1/1981 |
| JP | 61-55596 | 3/1986 |
| JP | 61-161398 | 7/1986 |
| JP | 61-217697 | 9/1986 |
| JP | 3-31665 | 2/1991 |
| JP | 6-159983 | 6/1994 |
| RU | 1546808 | 9/1990 |

* cited by examiner

*Primary Examiner*—Allen Flanigan
(74) *Attorney, Agent, or Firm*—Daniel J. Sepanik

(57) ABSTRACT

A heat exchanger and method of making same includes a plate extending longitudinally. The heat exchanger also includes a plurality of apertures forming a fluid inlet and a fluid outlet extending through the plate. The heat exchanger further includes a mechanism forming a restriction to fluid flow through either one of the fluid inlet or the fluid outlet.

16 Claims, 3 Drawing Sheets

HEAT EXCHANGER AND METHOD OF MAKING SAME

This is a divisional of application Ser. No. 09/470,383, filed Dec. 22, 1999, now U.S. Pat. No. 6,338,383.

BACKGROUND OF THE INVENTION

1. Field of the Invention

The present invention relates generally to heat exchangers and, more specifically, to a manifold and/or refrigerant plate and method of making same for a heat exchanger in a motor vehicle.

2. Description of the Related Art

It is known to provide plates for a heat exchanger such as an evaporator in a motor vehicle. Typically, opposed plates carry a first fluid medium in contact with an interior thereof while a second fluid medium contacts an exterior thereof. Typically, the first fluid medium is a refrigerant and the second fluid medium is air. Where a temperature difference exists between the first and second fluid mediums, heat will be transferred between the two via heat conductive walls of the plates.

It is also known to provide beaded plates for a heat exchanger in which beads define a plurality of passageways between the plates for movement of a fluid therethrough to increase the surface area of conductive material available for heat transfer and to cause turbulence of the fluid carried in a channel between the plates. An example of such a heat exchanger is disclosed in U.S. Pat. No. 4,600,053. In this patent, each of the plates has a plurality of beads formed thereon with one plate having one distinct variety of beads and the other plate having another distinct variety of beads. The beads of the plates contact each other and are bonded together to force fluid to flow therearound.

Performance of heat exchanger cores such as evaporator cores has been directly linked to refrigerant flow distribution through the core. This includes the flow distribution in a flow header or tank and a tube or plate areas. It is known that an effective way of generating a more uniform flow through the channel is by using a large plenum area upstream of the channel. Therefore, there is a need in the art to enhance the thermal performance in the heat exchanger core through the enhancement of coolant flow distribution inside the core.

The effectiveness of the refrigerant flow distribution through the core is measured by the thermal performance, refrigerant pressure drop, and infrared thermal image of the core skin temperature. Non-uniform distribution of flow starts at the flow header or tank area of the core.

The refrigerant pressure drop inside the core is controlled by several factors: heat transfer from the core to the air; flow restriction inside the core; non-uniform distribution of the refrigerant inside the core; and the change of phase from liquid to vapor because vapor has a higher pressure drop. The pressure drop can increase significantly when any combination or all of these factors are taking place together. Therefore, there is a need in the art to provide a heat exchanger with increased core thermal capacity, minimum increase in refrigerant pressure drop and minimum air temperature non-uniformity.

Therefore, it is desirable to restrict the flow in a back side of a manifold and/or refrigerant plate to improve refrigerant flow distribution inside a heat exchanger. It is also desirable to provide a manifold and/or refrigerant plate for a heat exchanger having a restriction to refrigerant in the heat exchanger. It is further desirable to provide a manifold and/or refrigerant plate having a restriction for a heat exchanger that improves refrigerant flow distribution inside the heat exchanger.

SUMMARY OF THE INVENTION

Accordingly, the present invention is a heat exchanger including a plate extending longitudinally and a plurality of plurality of apertures forming a fluid inlet and a fluid outlet extending through the plate. The heat exchanger also includes a mechanism forming a restriction to fluid flow through either one of the fluid inlet or the fluid outlet.

Also, the present invention is a method of making a heat exchanger. The method includes the steps of providing a plate extending longitudinally and forming a plurality of apertures in the plate and forming a fluid inlet and a fluid outlet. The method also includes the step of forming a restriction to fluid flow through either one of the fluid inlet or the fluid outlet.

One advantage of the present invention is that a heat exchanger such as an evaporator is provided for use in a motor vehicle. Another advantage of the present invention is that the heat exchanger has a restriction in a back side of a manifold and/or refrigerant plate that is either cross-shaped, round or multiple apertures. Yet another advantage of the present invention is that the heat exchanger has a restriction that improves the refrigerant flow distribution inside the heat exchanger by restricting the flow in the flow header or tank. Still another advantage of the present invention is that the heat exchanger has improved flow distribution using multiple apertures for a plate-fin heat exchanger such as an evaporator. A further advantage of the present invention is that the heat exchanger improves heat transfer by improving refrigerant flow distribution and enhancing flow mixing inside the flow header or tank. Yet a further advantage of the present invention is that a method of making the heat exchanger is provided with either a cross-shaped, round aperture or multiple aperture restriction in the back side thereof.

Other features and advantages of the present invention will be readily appreciated, as the same becomes better understood after reading the subsequent description taken in conjunction with the accompanying drawings.

DESCRIPTION OF THE PREFERRED EMBODIMENT(S)

Figure 1:
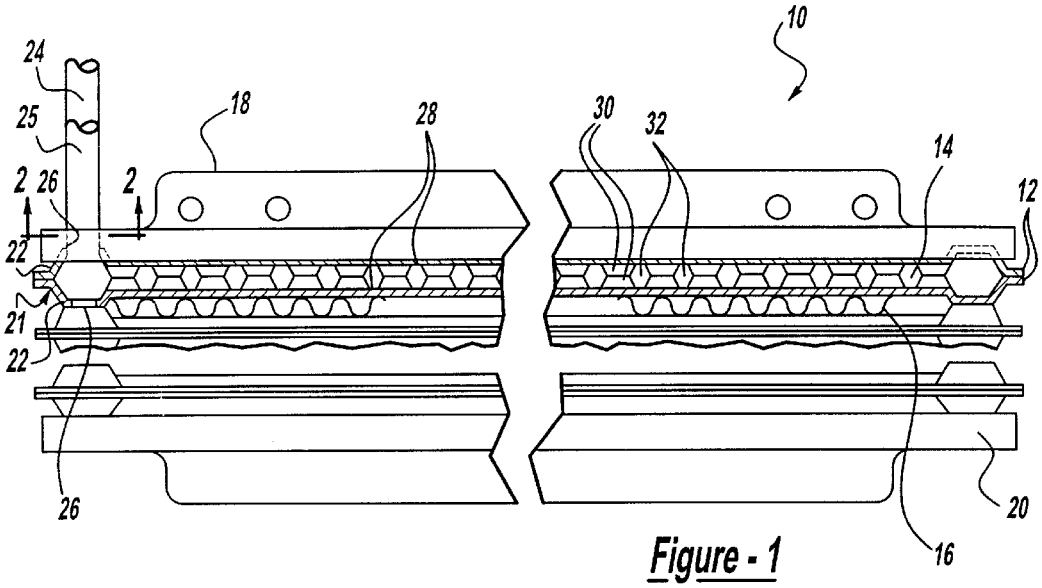
FIG. 1 is a fragmentary elevational view of a heat exchanger, according to the present invention.

Referring to the drawings and in particular FIG. 1, one embodiment of a heat exchanger 10, according to the present invention, such as an oil cooler, evaporator, or condenser, is shown for a motor vehicle (not shown). The heat exchanger 10 includes a plurality of generally parallel beaded plates 12, pairs of which are joined together in a face-to-face relationship to provide a channel 14 therebetween. The heat exchanger 10 also includes a plurality of convoluted or serpentine fins 16 attached an exterior of each of the beaded plates 12. The fins 16 are disposed between each pair of the joined beaded plates 12 to form a stack. The fins 16 serve as a means for conducting heat away from the beaded plates 12 while providing additional surface area for convective heat transfer by air flowing over the heat exchanger 10. The heat exchanger 10 further includes oppositely disposed first and second manifolds 18 and 20 at ends of the stack. The manifolds 18,20 fluidly communicate with flow headers, generally indicated at 21, formed by bosses 22 on each of the beaded plates 12. The heat exchanger 10 includes a fluid inlet tube 24 for conducting fluid into the heat exchanger 10 formed in the first manifold 18 and a fluid outlet tube 25 for directing fluid out of the heat exchanger 10 formed in the first manifold 18. It should be appreciated that, except for the manifold 18, the heat exchanger 10 is conventional and known in the art. It should also be appreciated that the manifold 18 could be used for heat exchangers in other applications besides motor vehicles.

Figure 2:
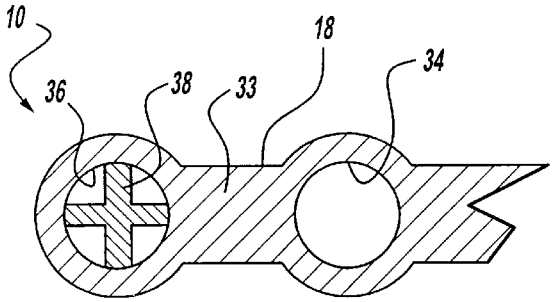
FIG. 2 is a sectional view taken along line 2—2 of FIG. 1.

Referring to FIGS. 1 and 2, the beaded plate 12, according to the present invention, extends longitudinally and is substantially planar or flat. The beaded plate 12 includes a raised boss 22 on at least one end having at least one aperture 26 extending therethrough. The apertures 26 form an inlet (not shown) and an outlet (not shown) spaced transversely and divided by a wall (not shown). The bosses 22 are stacked together such that the apertures 26 are aligned to form the flow header 21 to allow parallel flow of fluid through the channels 14 of the beaded plates 12. It should be appreciated that such flow headers 21 are conventional and known in the art.

The beaded plate 12 includes a surface 28 being generally planar and extending longitudinally and laterally. The beaded plate 12 also includes a plurality of beads 30 extending above and generally perpendicular to a plane of the surface 28 and spaced laterally from each other. The beads 30 are generally circular in shape and have a predetermined diameter such as three millimeters. The beads 30 have a predetermined height such as 1.5 millimeters. It should be appreciated that the beads 30 may have a generally frusto-conical cross-sectional shape. It should also be appreciated that the beads 30 are formed in a plurality of rows, which are repeated, with each row containing a plurality of, preferably a predetermined number of beads 30 in a range of two to eleven.

The beaded plate 12 is made of a metal material such as aluminum or an alloy thereof and has a cladding on its inner and outer surfaces for brazing. In the embodiment illustrated, a pair of the beaded plates 12 are arranged such that the beads 30 contact each other to form a plurality of flow passages 32 in the channel 14 as illustrated in FIG. 1. The beads 30 turbulate fluid flow through the channel 14. It should be appreciated that the beads 30 are brazed to each other. It should also be appreciated that the entire heat exchanger 10 is brazed together as is known in the art.

Figure 5:
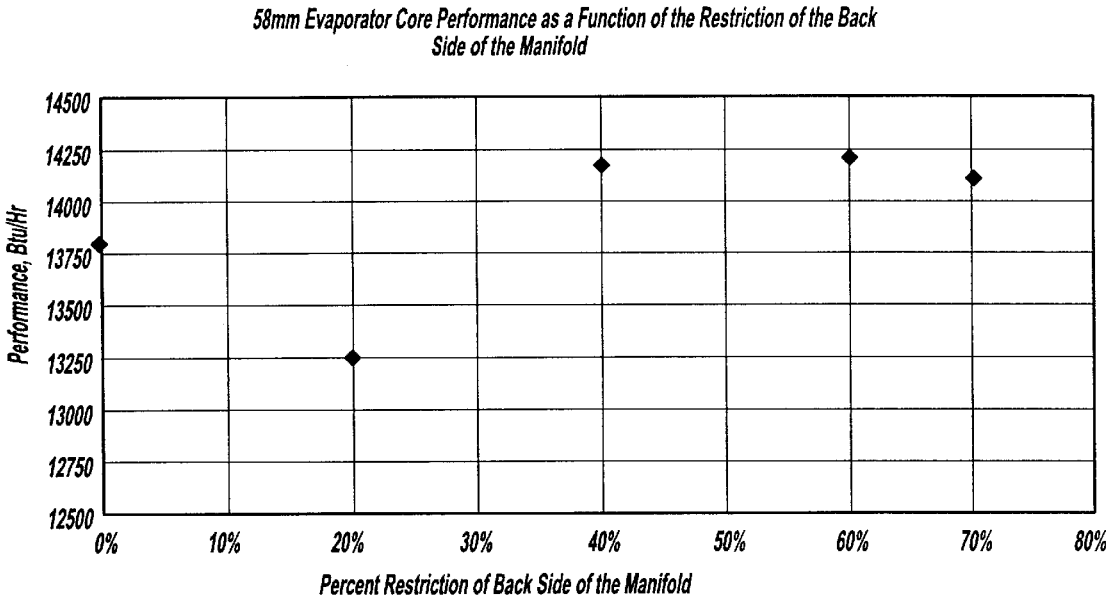
FIG. 5 is a graph of heat exchanger core performance as a function of an inlet/outlet restriction for a manifold of the heat exchanger of FIG. 2.
Figure 6:
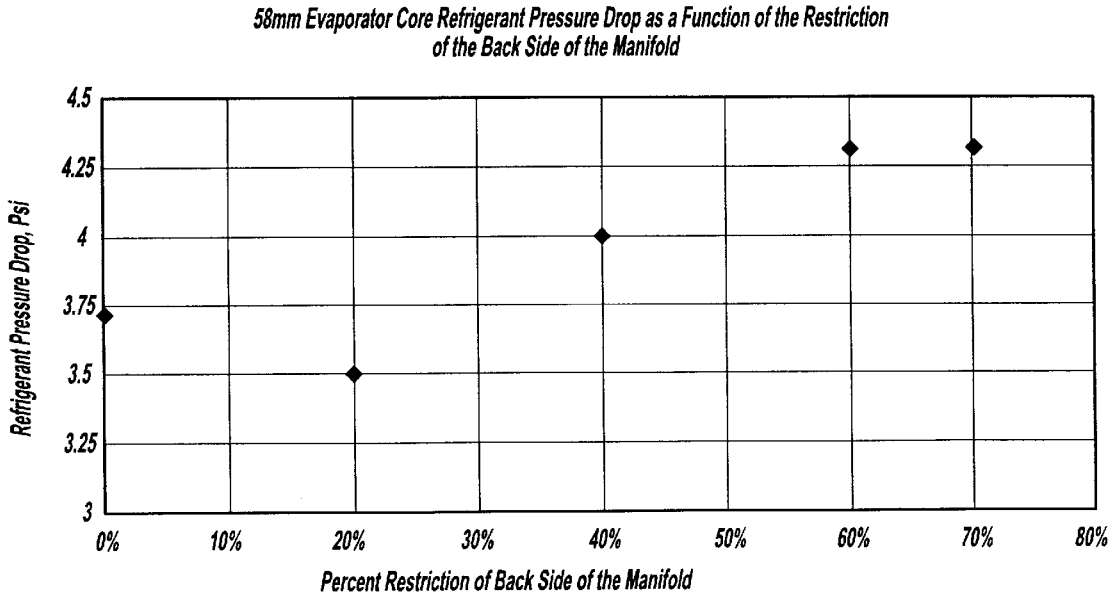
FIG. 6 is a graph of heat exchanger core refrigerant pressure drop as a function of an inlet/outlet restriction for a manifold of the heat exchanger of FIG. 2.

Referring to FIGS. 1 and 2, the manifold 18, according to the present invention, has a plate 33 extending longitudinally and a first aperture 34 and a second aperture 36 spaced laterally and extending through the plate 33. The first aperture 34 forms a fluid inlet and communicates with the fluid inlet tube 24. The second aperture 36 forms a fluid outlet and communicates with the fluid outlet tube 25. The first aperture 34 and second aperture 36 have approximately the same diameter. The manifold 18 also includes a restriction 38 in the fluid outlet to distribute the refrigerant flow more uniformly inside the flow header 21 for the heat exchanger 10. The restriction 38 is formed as a cross-shaped or plus-shaped member disposed in the second aperture 36 forming the fluid outlet as illustrated in FIG. 2. The restriction 38 improves the core performance of the heat exchanger 10 significantly with more uniform flow distribution of the refrigerant in the flow header area. The size of the restriction 38 was determined using the data in FIGS. 5 and 6. This data was plotted as a function of the non-dimensional quantity:

$$\frac{(\text{Manifold Hydraulic Area without Restriction} - \text{Manifold Hydraulic Area with Restriction})}{\text{Manifold Hydraulic Area without Restriction}} \times 100$$

It should be appreciated that the restriction 38 can be formed in the aperture 26 of the beaded plate 12. It should also be appreciated that the restriction 38 can be formed in either the fluid inlet or fluid outlet of the beaded plate 12 and/or manifold 18. It should further be appreciated that the restriction 38 is variable by modifying the restriction where desired for the beaded plates 12 and/or manifold 18 to even flow through the heat exchanger 10. It should still further be appreciated that the restriction 38 can be applied to both single and dual tank evaporator type heat exchangers.

Figure 3:
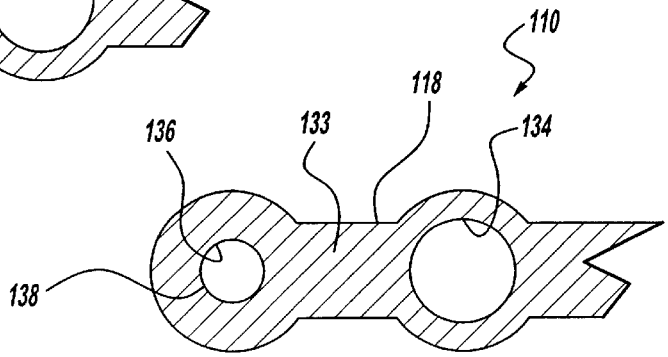
FIG. 3 is a view similar to FIG. 2 of another embodiment, according to the present invention, of the heat exchanger of FIG. 1.
Figure 7:
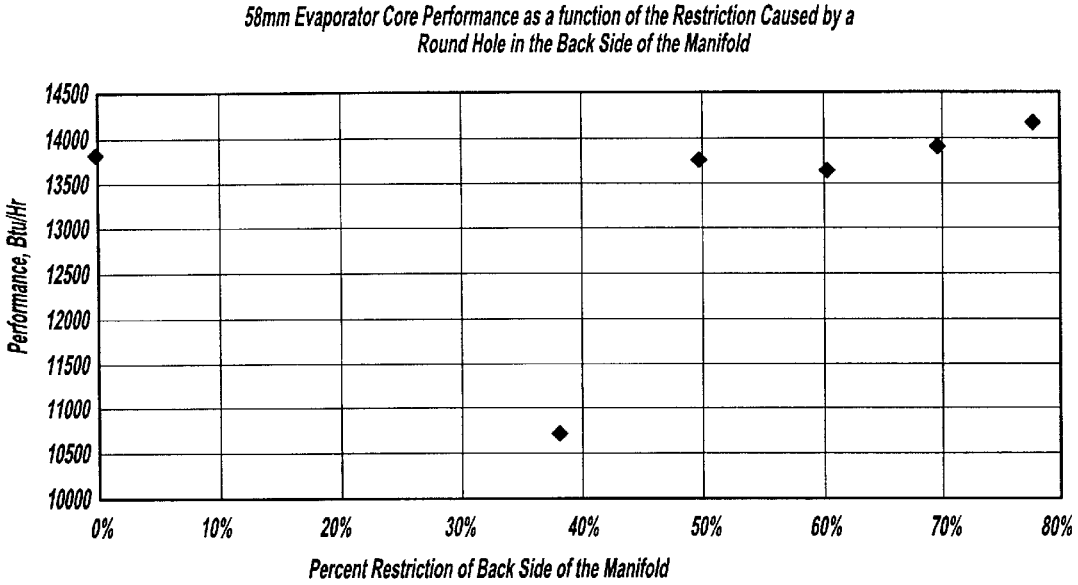
FIG. 7 is a graph of heat exchanger core performance as a function of an inlet/outlet restriction for a manifold of the heat exchanger of FIG. 3.
Figure 8:
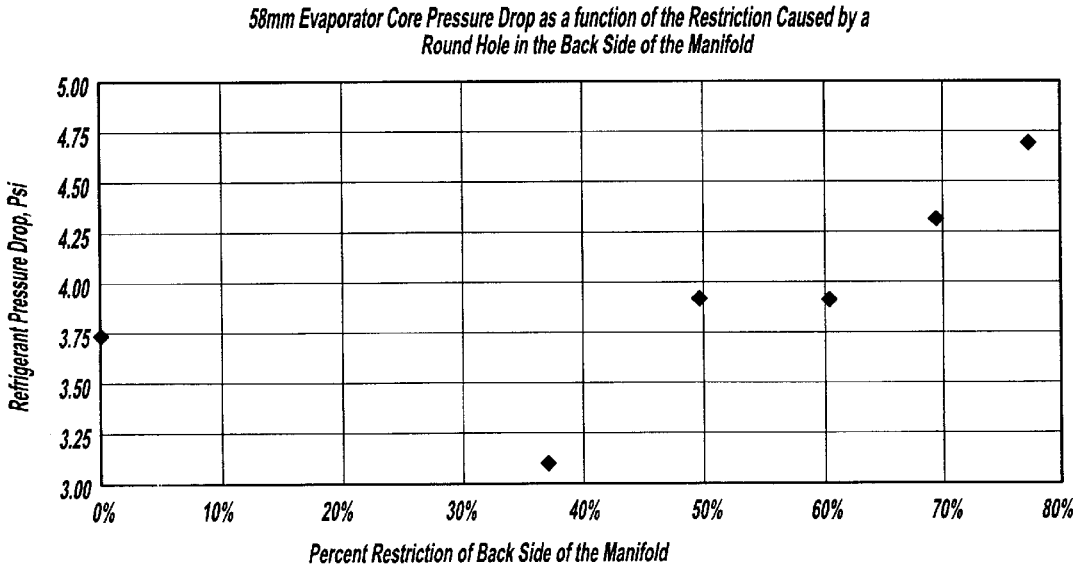
FIG. 8 is a graph of heat exchanger core refrigerant pressure drop as a function of an inlet/outlet restriction for a manifold of the heat exchanger of FIG. 3.

Referring to FIG. 3, another embodiment 110, according to the present invention, of the heat exchanger 10 is shown. Like parts of the heat exchanger 10 have like reference numerals increased by one hundred (100). In this embodiment, the heat exchanger 110 includes the manifold 118 having the plate 133 extending longitudinally and a first aperture 134 and a second aperture 136 spaced laterally and extending through the plate 133. The first aperture 134 forms a fluid inlet and communicates with the fluid inlet tube 24. The second aperture 136 forms a fluid outlet and communicates with the fluid outlet tube 25. The manifold 118 also includes a restriction 138 in the fluid outlet to distribute the refrigerant flow more uniformly inside the flow header 121 for the heat exchanger 110. In this embodiment, the restriction 138 is formed as the second aperture 136 having a circular cross-sectional shape and a diameter less than a diameter of the first aperture 134 as illustrated in FIG. 3. The restriction 138 improves the core performance of the heat exchanger 110 significantly with more uniform flow distribution of the refrigerant in the flow header area. The size of the restriction 138 was determined using the data in FIGS. 7 and 8. This data was plotted as a function of the non-dimensional quantity:

$$\frac{\text{Manifold Hydraulic Area without Restriction} - \text{Manifold Hydraulic Area with Restriction}}{\text{Manifold Hydraulic Area without Restriction}} \times 100$$

It should be appreciated that the restriction 138 can be formed in the aperture 26 of the beaded plate 12. It should also be appreciated that the restriction 138 can be formed in either the fluid inlet or fluid outlet of the beaded plate 12 and/or manifold 118. It should further be appreciated that the restriction 138 can be applied to both single and dual tank evaporator type heat exchangers.

Figure 4:
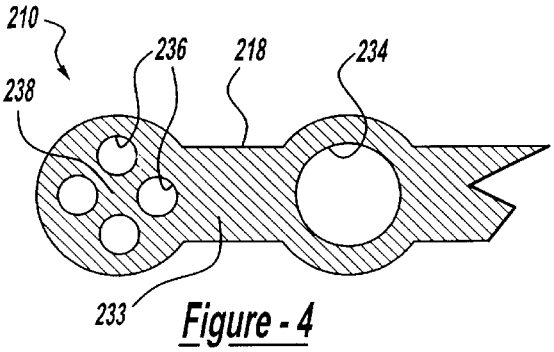
FIG. 4 is a view similar to FIG. 2 of yet another embodiment, according to the present invention, of the heat exchanger of FIG. 1.

Referring to FIG. 4, yet another embodiment 210, according to the present invention, of the heat exchanger 10 is shown. Like parts of the heat exchanger 10 have like reference numerals increased by two hundred (200). In this embodiment, the heat exchanger 210 includes the manifold 218 having a plate 233 extending longitudinally and a first aperture 234 and a second aperture 236 spaced laterally and extending through the plate 233. The first aperture 234 forms a fluid inlet and communicates with the fluid inlet tube 24. The second aperture 236 forms a fluid outlet and communicates with the fluid outlet tube 25. The manifold 218 also includes a restriction 238 in the fluid outlet to distribute the refrigerant flow more uniformly inside the flow header 21 for the heat exchanger 210. In this embodiment, the restriction 238 is formed as a plurality of second apertures 236 having a circular cross-sectional shape and a diameter less than a diameter of the first aperture 234. Preferably, the diameter of the second apertures 236 is approximately two millimeters to approximately five millimeters. Preferably, the radial distance between opposed second apertures 236 is approximately two millimeters to approximately eight millimeters as illustrated in FIG. 4. The restriction 238 improves the core performance of the heat exchanger 210 significantly with more uniform flow distribution of the refrigerant in the flow header area. It should be appreciated that the restriction 238 can be formed in the aperture 26 of the beaded plate 12. It should also be appreciated that the restriction 238 can be formed in either the fluid inlet or fluid outlet of the beaded plate 12 and/or manifold 218. It should further be appreciated that the restriction 238 can be applied to both single and dual tank evaporator type heat exchangers.

Additionally, a method of making the heat exchanger 10,110,210, according to the present invention, is disclosed. The method includes the step of providing a plate 33,133, 233,12 extending longitudinally. The method includes the step of forming a first aperture 34,134,234,26 extending through the plate 33,133,233,12 as a fluid inlet and at least one second aperture 36,136,236,26 spaced laterally from the first aperture 34,134,234,26,126,226 and extending through the plate 33,133,233,12 as a fluid outlet. The method also includes the steps of forming a restriction 38,138,238 in either one of the fluid inlet or fluid outlet. The step of forming is carried out by punching the apertures 34,134, 234,36,136,236,26 and restriction 38,138,238 in the plate 33,133,233,12 by conventional punching processes. It should be appreciated that the size of the apertures 34,134, 234,36,136,236,26 could be such that they are relatively small, then progressively get bigger traveling down a length of the stacked beaded plates 12.

Also, a method of making the heat exchanger 10, according to the present invention, is shown. The method includes the step of contacting first and second beaded plates 12 with each other to form the channel 14 therebetween and contact opposed beads 30 with each other to form the fluid flow passages 32 as illustrated in FIG. 1. The method includes the step of brazing a pair of the beaded plates 12 by heating the beaded plates 12 to a predetermined temperature to melt the brazing material to braze the bosses 22 and the beads 30 of the beaded plates 12 together. The pair of joined beaded plates 12 is then cooled to solidify the molten braze material to secure the bosses 22 together and the beads 30 together. The method includes the step of disposing fins 16 between joined pairs of the beaded plates 12 and brazing the fins 16 and beaded plates 12 together. The method includes the steps of connecting the first and second manifolds 18 and 20 to the brazed fins 16 and beaded plates 12 and brazing them together to form the heat exchanger 10.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A heat exchanger comprising:

a plate extending longitudinally;

a manifold extending longitudinally and disposed adjacent the plate, said manifold having a plurality of first apertures forming either one of a fluid inlet and a fluid outlet and a single second aperture forming the other one of the fluid inlet and fluid outlet spaced laterally from said first apertures, said first apertures and said second aperture being disposed at one longitudinal end of said manifold; and a mechanism comprising said first apertures forming a restriction to fluid flow through the one of said fluid inlet and said fluid outlet.

2. A heat exchanger as set forth in claim 1 wherein said first apertures have a generally circular cross-sectional shape.

3. A heat exchanger as set forth in claim 1 wherein each of said first apertures have a diameter less than a diameter of said second aperture.

4. A heat exchanger as set forth in claim 1 wherein said second aperture has a generally circular cross-sectional shape.

5. A heat exchanger comprising:

a plurality of generally parallel plates, pairs of said plates being joined together in a face-to-face relationship to provide a channel therebetween, the pairs of said plates being joined together and aligned in a stack;

a plurality of fins attached to an exterior of said plates and disposed between each pair of said joined plates; and a manifold extending longitudinally and disposed at one end of the stack having a plurality of first apertures forming either one of a fluid inlet and a fluid outlet and a single second aperture forming the other one of the fluid inlet and fluid outlet and spaced laterally from said first apertures, said first apertures and said second aperture being disposed at one longitudinal end of said manifold, and a mechanism comprising said first apertures forming a restriction to fluid flow through the one of said fluid inlet and said fluid outlet.

6. A heat exchanger as set forth in claim 5 wherein said first apertures have a generally circular cross-sectional shape.

7. A heat exchanger as set forth in claim 5 wherein each of said first apertures have a diameter less than a diameter of said second aperture.

8. A heat exchanger as set forth in claim 5 wherein said second aperture has a generally circular cross-sectional shape.

9. A method of making a heat exchanger comprising the steps of:

providing a plate extending longitudinally;

providing a manifold extending longitudinally to be disposed adjacent the plate and forming a plurality of first apertures as either one of a fluid inlet and a fluid outlet and forming a single second aperture as the other one of the fluid inlet and fluid outlet spaced laterally from the first apertures, the first apertures and the second aperture being disposed at one longitudinal end of the manifold; and forming a restriction to fluid flow through the one of the fluid inlet or the fluid outlet by the first apertures.

10. A method as set forth in claim 9 wherein said step of forming a plurality of first apertures comprises forming the first apertures with a generally circular cross-sectional shape.

11. A method as set forth in claim 9 wherein said step of forming a plurality of first apertures comprises forming the first apertures having a diameter less than a diameter of the second aperture.

12. A method as set forth in claim 9 wherein said step of forming a single second aperture comprises forming the second aperture with a generally circular cross-sectional shape.

13. A method of making a heat exchanger comprising the steps of:

providing a plurality of generally parallel plates, pairs of the plates being joined together in a face-to-face relationship to provide a channel therebetween, the pairs of the plates being joined together and aligned in a stack;

providing a manifold extending longitudinally and forming a plurality of first apertures as either one of a fluid inlet and a fluid outlet and forming a single second aperture as the other one of the fluid inlet and fluid outlet spaced laterally from the first apertures, the first apertures and the second aperture being disposed at one longitudinal end of the manifold;

providing a restriction in the one of the fluid inlet and fluid outlet by the first apertures and disposing the manifold at either end of the stack;

providing a plurality of fins to be attached to an exterior of the plates and disposing the fins between each pair of the joined plates; and joining the fins and pairs of joined plates and manifold together to form the heat exchanger.

14. A method as set forth in claim 13 wherein said step of forming a plurality of first apertures comprises forming the first apertures with a generally circular cross-sectional shape.

15. A method as set forth in claim 13 wherein said step of forming a plurality of first apertures comprises forming the first apertures having a diameter less than a diameter of the second aperture.

16. A method as set forth in claim 13 wherein said step of forming a single second aperture comprises forming the second aperture with a generally circular cross-sectional shape.

* * * * *